US009316197B2

(12) United States Patent
Rangger et al.

(10) Patent No.: US 9,316,197 B2
(45) Date of Patent: Apr. 19, 2016

(54) METHOD FOR STARTING AN INTERNAL COMBUSTION ENGINE

(71) Applicant: GE Jenbacher GmbH & Co OHG, Jenbach (AT)

(72) Inventors: Alfred Rangger, Kramsach (AT); Lukas Zahner, Rosenheim (DE)

(73) Assignee: GE JENBACHER GMBH & CO OHG, Jenbach (AT)

( * ) Notice: Subject to any disclaimer, the term of this patent is extended or adjusted under 35 U.S.C. 154(b) by 50 days.

(21) Appl. No.: 14/107,310

(22) Filed: Dec. 16, 2013

(65) Prior Publication Data

US 2014/0102409 A1 Apr. 17, 2014

Related U.S. Application Data

(63) Continuation of application No. PCT/AT2012/000153, filed on Jun. 5, 2012.

(30) Foreign Application Priority Data

Jun. 17, 2011 (AT) ..... 887/2011

(51) Int. Cl.
*F02N 11/08* (2006.01)
*F02N 15/00* (2006.01)
(Continued)

(52) U.S. Cl.
CPC *F02N 15/00* (2013.01); *F02N 7/08* (2013.01); *F02N 11/08* (2013.01); *F02N 11/087* (2013.01);
(Continued)

(58) Field of Classification Search
CPC ..... F02N 11/106; F02N 11/101; F02N 11/08; F02N 11/0848; F02N 11/087; F02N 11/10; F02N 15/00
USPC ..... 123/319, 179.1, 179.3, 179.4
See application file for complete search history.

(56) References Cited

U.S. PATENT DOCUMENTS

| | | | | |
|---|---|---|---|---|
| 4,494,499 | A | 1/1985 | Stein | |
| 5,337,713 | A * | 8/1994 | Mills | 123/179.3 |
| 2011/0144894 | A1 | 6/2011 | Marriott et al. | |

FOREIGN PATENT DOCUMENTS

| | | |
|---|---|---|
| CN | 1032694 | 5/1989 |
| CN | 102094722 | 6/2011 |

(Continued)

OTHER PUBLICATIONS

International Search Report issued Oct. 31, 2012 in International Application No. PCT/AT2012/000153.

(Continued)

*Primary Examiner* — Mahmoud Gimie
(74) *Attorney, Agent, or Firm* — Wenderoth, Lind & Ponack, L.L.P.

(57) ABSTRACT

A method for starting an internal combustion engine, particularly a stationary gas engine, includes driving the engine by at least one starter motor. The starting process is interrupted once the starter motor has been started if the angular acceleration of the internal combustion engine remains below a predefinable acceleration value and/or if, within a predefinable first time period, the actual rotational speed remains below a predefinable first rotational speed threshold value and/or if, within a predefinable second time period, the average rotational speed of the internal combustion engine remains below a predefinable second rotational speed threshold value. The starter motor is designed as a pneumatic starter motor and the compressed air supply thereof is controlled by a compressed air valve which can be switched between a fully opened position and a fully closed position, the pneumatic starter motor being started by the compressed air valve being fully opened.

13 Claims, 6 Drawing Sheets

(51) Int. Cl.

| | |
|---|---|
| ***F02N 11/10*** | (2006.01) |
| ***F02N 7/08*** | (2006.01) |
| ***F02N 15/10*** | (2006.01) |

(52) U.S. Cl.

CPC ..... *F02N 11/0848* (2013.01); *F02N 11/10* (2013.01); *F02N 11/101* (2013.01); *F02N 11/106* (2013.01); *F02N 15/10* (2013.01)

(56) References Cited

FOREIGN PATENT DOCUMENTS

| | | |
|---|---|---|
| DE | 102 45 640 | 4/2004 |
| FR | 2 927 301 | 8/2009 |
| GB | 1 331 572 | 9/1973 |
| JP | 60-150440 | 8/1985 |
| JP | 2002-188548 | 7/2002 |
| JP | 2004-003434 | 1/2004 |
| JP | 2006-63867 | 3/2006 |
| JP | 4343059 | 7/2009 |

OTHER PUBLICATIONS

Austrian Search Report issued Dec. 6, 2011 in Austrian Application No. A 887/2011, with English translation.

Chinese Search Report issued Jul. 3, 2015 in corresponding Chinese Application No. 201280036265.6.

* cited by examiner

METHOD FOR STARTING AN INTERNAL COMBUSTION ENGINE

BACKGROUND OF THE INVENTION

The invention concerns a method of starting an internal combustion engine, in particular a stationary gas engine, wherein the internal combustion engine is driven by at least one starter motor. After starting of the starter motor, the starting process is broken off if the angular acceleration of the internal combustion engine remains below a predeterminable acceleration value and/or if within a predeterminable first time the actual rotary speed remains below a predeterminable first rotary speed threshold value and/or within a predeterminable second time the average rotary speed of the internal combustion engine remains below a predeterminable second rotary speed threshold value.

The invention further concerns a starter system for starting an internal combustion engine, in particular a stationary gas engine, with at least one starter motor to which energy can be fed by an energy source. The starter motor can be connected to a drive shaft of the internal combustion engine by which the drive shaft is drivable. A control device monitors the actual rotary speed and/or the angular speed and/or the angular acceleration of the internal combustion engine, and the control device stops or activates the feed of energy to the at least one starter motor in dependence on the actual rotary speed and/or the angular speed and/or the angular acceleration.

Methods of starting an internal combustion engine in which the rotary speed of the internal combustion engine is used as a criterion for interrupting a starting process are already known (for example DE 102 45 640 B3, FR 2 927 301 A1 and JP 2006-063867 A).

If in an internal combustion engine, water penetrates into the combustion chamber of one or more cylinders while the engine is stationary, then the incompressible water can cause damage to the connecting rod and/or piston in a conventional starting process for the internal combustion engine. The water penetrating into the combustion chamber can be for example cooling water from a leaking coolant conduit. If the internal combustion engine were to be completely started in a condition of partially flooded cylinders, water hammer occurs. In that case, the piston in question is abruptly decelerated at the upper position in the compression cycle by the incompressible water, and that can cause engine damage. Moisture sensors, for example, can be used to detect water or moisture in a cylinder of an internal combustion engine. However such sensors cannot distinguish between normal condensate water which can occur in the case of large stationary internal combustion engines because of the chimney effect of the exhaust installation, and dangerous flooding of the cylinder.

Water in a cylinder can be detected by the internal combustion engine accelerating more slowly as a consequence of an increased level of resistance because of the water in the cylinder, than in the normal condition, upon being actuated by the at least one starter motor. During the starting process, therefore, the actual rotary speed and/or the angular speed and/or the angular acceleration of the internal combustion engine can be measured and anomalies can be detected by comparison with predeterminable limit values.

If therefore the measured angular acceleration of the internal combustion engine remains below a predeterminable acceleration value, and/or within a predeterminable first time the actual rotary speed remains below a predeterminable first rotary speed limit value, and/or within a predeterminable second time the average rotary speed of the internal combustion engine remains below a predeterminable second rotary speed limit value, the starting operation can then be interrupted before the internal combustion engine suffers damage due to water hammer.

SUMMARY OF THE INVENTION

The object of the present invention is to provide an improved method and an improved starter system. In particular, the invention seeks to start an internal combustion engine by a simple and inexpensive method and starter system.

In a method of the kind set forth in the opening part of this specification, that object is attained in that the starter motor is in the form of a pneumatic starter motor whose compressed air feed is controlled by a compressed air valve. The compressed air valve can be switched over between a completely opened position and a completely closed position, and starting of the pneumatic starter motor is effected by complete opening of the compressed air valve.

In the case of a starter system of the general kind set forth in the opening of this specification, that object is attained in that the at least one starter motor is in the form of a pneumatic starter motor drivable by compressed air by a compressed air source. A compressed air valve is provided between the compressed air source and the starter motor. The compressed air valve can be switched over between a completely opened position and completely closed position. For stopping the compressed air feed, the control device causes the compressed air valve to be switched over to the completely closed position. For activating the compressed air feed, the control device causes the compressed air valve to be switched over into the completely opened position.

The use of a pneumatic starter motor whose compressed air feed is controlled by a compressed air valve, in which the compressed air valve can be switched over between a completely opened position and a completely closed position, makes it possible to provide a simple and inexpensive method and starter system without having to use costly regulating valves or compressed air throttles.

Preferably after starting of the starter motor, the starting process is broken off if the actual rotary speed remains below 8 rpm within 3 s.

The starting process can include the following steps:

a) complete opening of the compressed air valve and thus acceleration of the internal combustion engine, b) complete closing of the compressed air valve and thus reduction in the actual rotary speed as soon as the actual rotary speed reaches a predeterminable maximum rotary speed.

c) complete opening of the compressed air valve as soon as the actual rotary speed reaches a predeterminable threshold value rotary speed, d) break-off of the starting process if, in spite of complete opening of the compressed air valve, the actual rotary speed falls below a predeterminable minimum rotary speed and/or the angular acceleration of the internal combustion engine remains below a predeterminable acceleration value.

It has proven to be particularly advantageous in that respect if steps a) through d) are carried out more than once, preferably four times. That is advantageous in particular when the compressed air feed to a starter motor is effected by way of simple unregulated two-way compressed air valves which can have only a completely opened position or a completely closed position. The proposed method can therefore avoid damage to the internal combustion engine due to water hammer, while using inexpensive components of the starter system. Because the internal combustion engine is initially accelerated only to a relatively low maximum speed, whereupon the compressed air valve is switched over from the completely opened position into the completely closed position, the feed of energy to the starter motor can be reduced without having to use costly regulated valves or compressed air throttles.

Preferably, the predeterminable maximum rotary speed is at most 30 rpm, preferably 20 rpm, and the predeterminable threshold value rotary speed is in a range of between 12 and 18 rpm, preferably being 15 rpm. To detect a rotary speed drop, in particular because of water in a cylinder, the predeterminable minimum rotary speed is less than 10 rpm, preferably less than or equal to 8 rpm.

In general, the completely opened compressed air valve is held in the completely opened position in each case only up to a predeterminable maximum period of time, for example between 2 and 3 s, in order to limit the feed of energy to the starter motor.

BRIEF DESCRIPTION OF THE DRAWINGS

Further details and advantages of the invention will be described by means of the following Figures and specific description, in which.

DETAILED DESCRIPTION OF THE INVENTION

Figure 1:
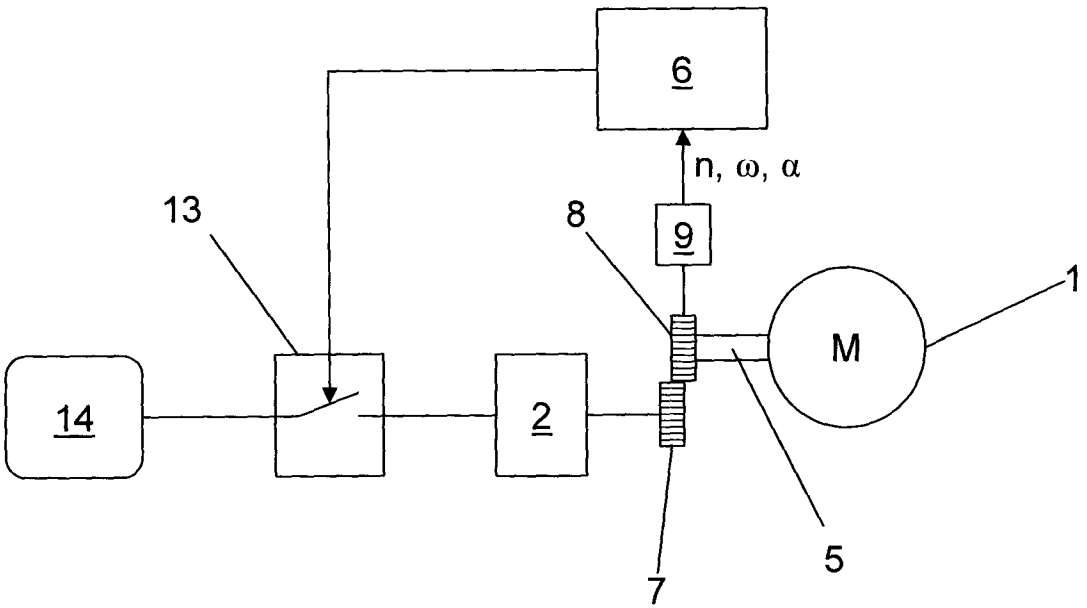
FIG. 1 shows a diagrammatic structure of an embodiment of a starter system with an electric starter motor.

FIG. 1 diagrammatically shows an internal combustion engine 1 having a drive shaft 5 and a ring gear 8 arranged thereon. To start the internal combustion engine 1, a starter pinion 7 connected to a starter motor 2 is brought into mesh in a known manner by a meshing mechanism 11 (not shown here) and thus brought into engagement with the ring gear 8 of the internal combustion engine 1 (see FIG. 3). In this case, the starter motor 2 is an electric starter motor which is supplied with electric voltage or electric current by an energy source in the form of an electric voltage source 14. To control the voltage supply to the electric starter motor 2, between the voltage source 14 and the starter motor 2 is a switch 13 actuable by a control device 6.

The rotary speed n and/or the angular speed w and/or the angular acceleration a of the drive shaft 5 of the internal combustion engine 1 is or are detected by a measuring device 9 and signaled to the control device 6. The measuring device 9 can be, for example, an inductive pickup which can be arranged at the teeth of ring gear 8. To achieve a high level of measurement resolution, the ring gear 8 can have a large number of teeth, for example more than 300 teeth. Depending on the signals of the measuring device 9, the control device 6 causes closing or opening of the switch 13 and thus activates or stops the feed of energy from the voltage source 14 to the electric starter motor 2.

Figure 2:
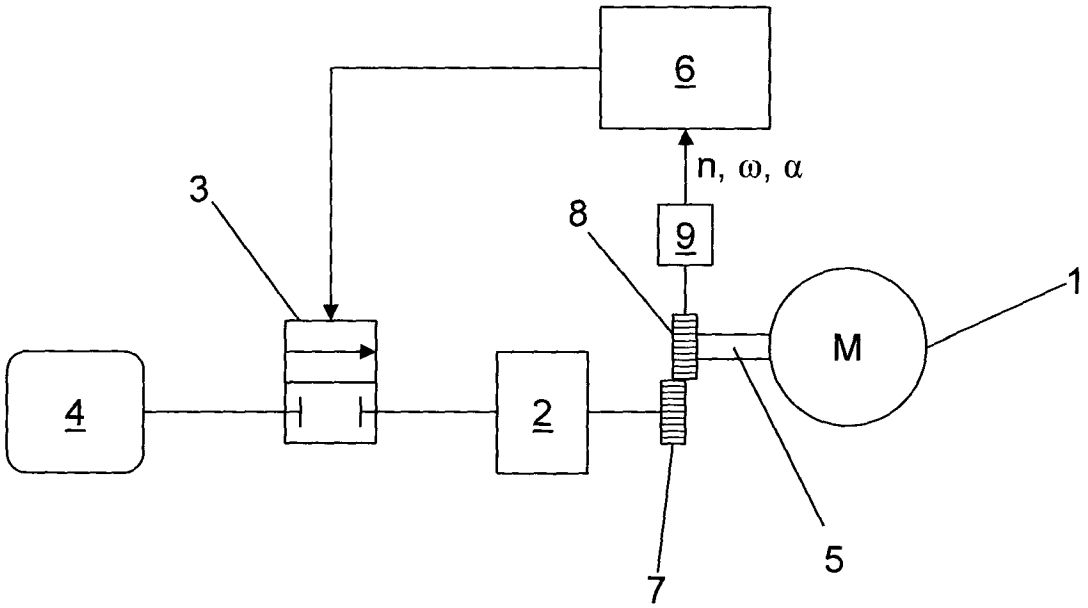
FIG. 2 shows a diagrammatic structure of an embodiment of a proposed starter system with an pneumatic starter motor.

FIG. 2 shows a diagrammatic arrangement similar to that shown in FIG. 1, but in this case the starter motor 2 is a pneumatic starter motor supplied by an energy source in the form of a compressed air source 4. Arranged between the compressed air source 4 and the starter motor 2 is a compressed air valve 3 which is in the form of a two-way valve and which can have only a completely opened or a completely closed position. In the illustrated view, the compressed air valve 3 is in its completely closed position (that is to say, the feed of compressed air from the compressed air source 4 to the starter motor 2 is interrupted, and the starter motor 2 does not drive the drive shaft 5 of the internal combustion engine 1). Depending on the signals from the measuring device 9, the control device 6 causes complete opening or complete closing of the compressed air valve 3 which for example can be in the form of an electrically, magnetically or pneumatically actuable valve.

Figure 3:
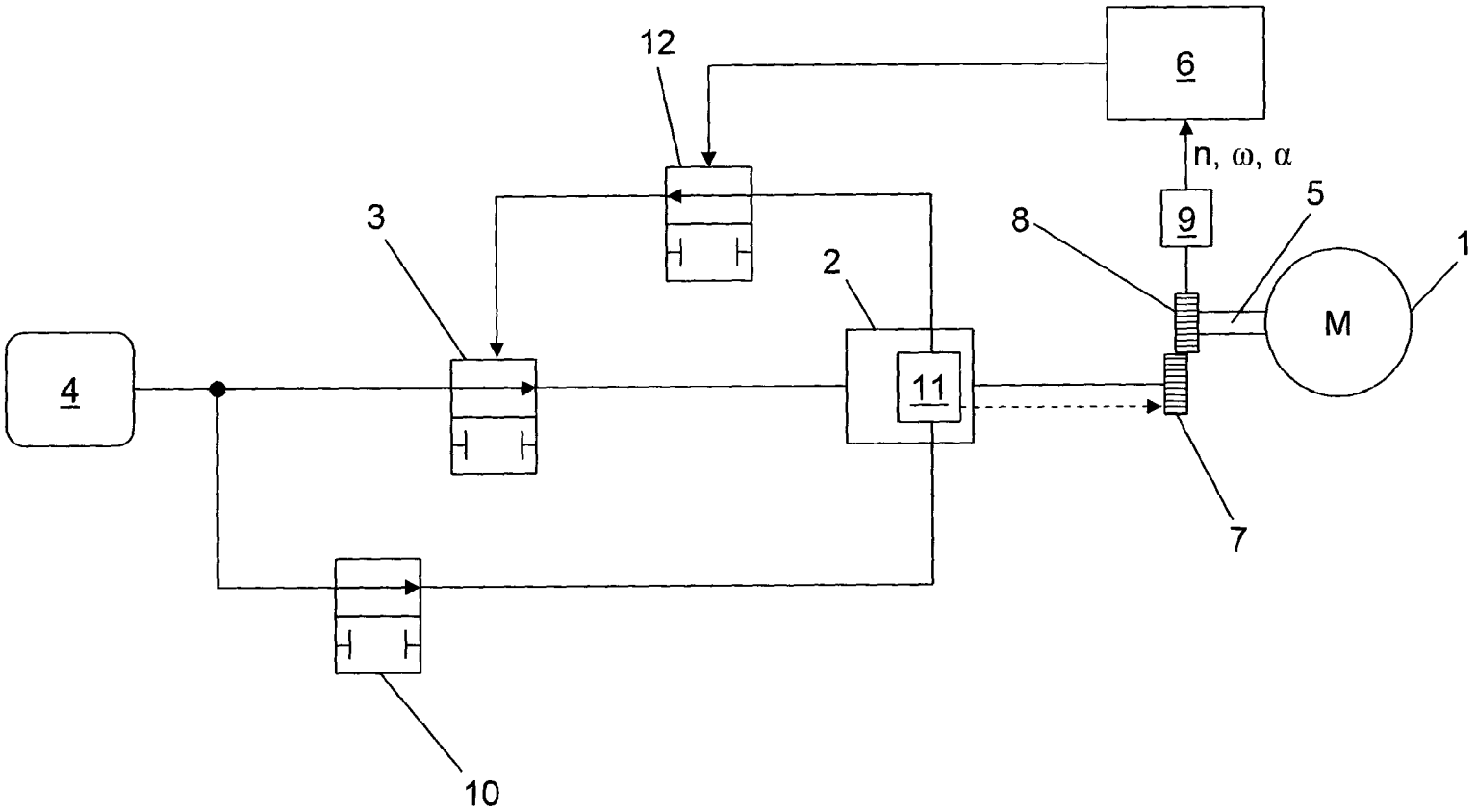
FIG. 3 shows a diagrammatic structure of a further embodiment of a proposed starter system with a control valve.

FIG. 3 shows an arrangement as shown in FIG. 2, wherein a separate control valve 12 is provided for actuation of a compressed air valve 3 which in this embodiment is in the form of a pneumatically actuable 2-way valve. A starting valve 10 which is connected to the compressed air source 4 and which, for example, can be in the form of a solenoid valve is opened to activate the starting process. As a result, a pneumatic meshing mechanism 11 which can be part of the starter motor 2 is acted upon with compressed air from the compressed air source 4. The meshing mechanism 11 thereby brings the starter pinion 7 of the starter motor 2 into engagement with the ring gear 8 on the drive shaft 5 of the internal combustion engine 1. That can be effected, for example, by a translatory displacement of the starter pinion 7 so that the teeth of the starter pinion 7 and the teeth of the ring gear 8 can correspondingly engage into each other. That process is indicated by the dash-dotted arrow from the meshing mechanism 11 to the starter pinion 7.

The compressed air fed to the meshing mechanism 11 is passed further to the control valve 12 through the meshing mechanism 11. Depending on the signal or signals of the measuring device 9, the control device 6 opens or closes the control valve 12. Depending on the position of the control valve 12, the compressed air valve 3 is either completely opened to supply the starter motor 2 with compressed air from the compressed air source 4, or completely closed to interrupt the compressed air feed for the starter motor 2. The starting valve 10, the control valve 12, and the compressed air valve 3 are in their opened positions in this view, that is to say the starter motor 2 is acted upon with compressed air from the compressed air source 4 and drives the drive shaft 5 of the internal combustion engine 1 by way of the starter pinion 7 and the ring gear 8.

Figure 4:
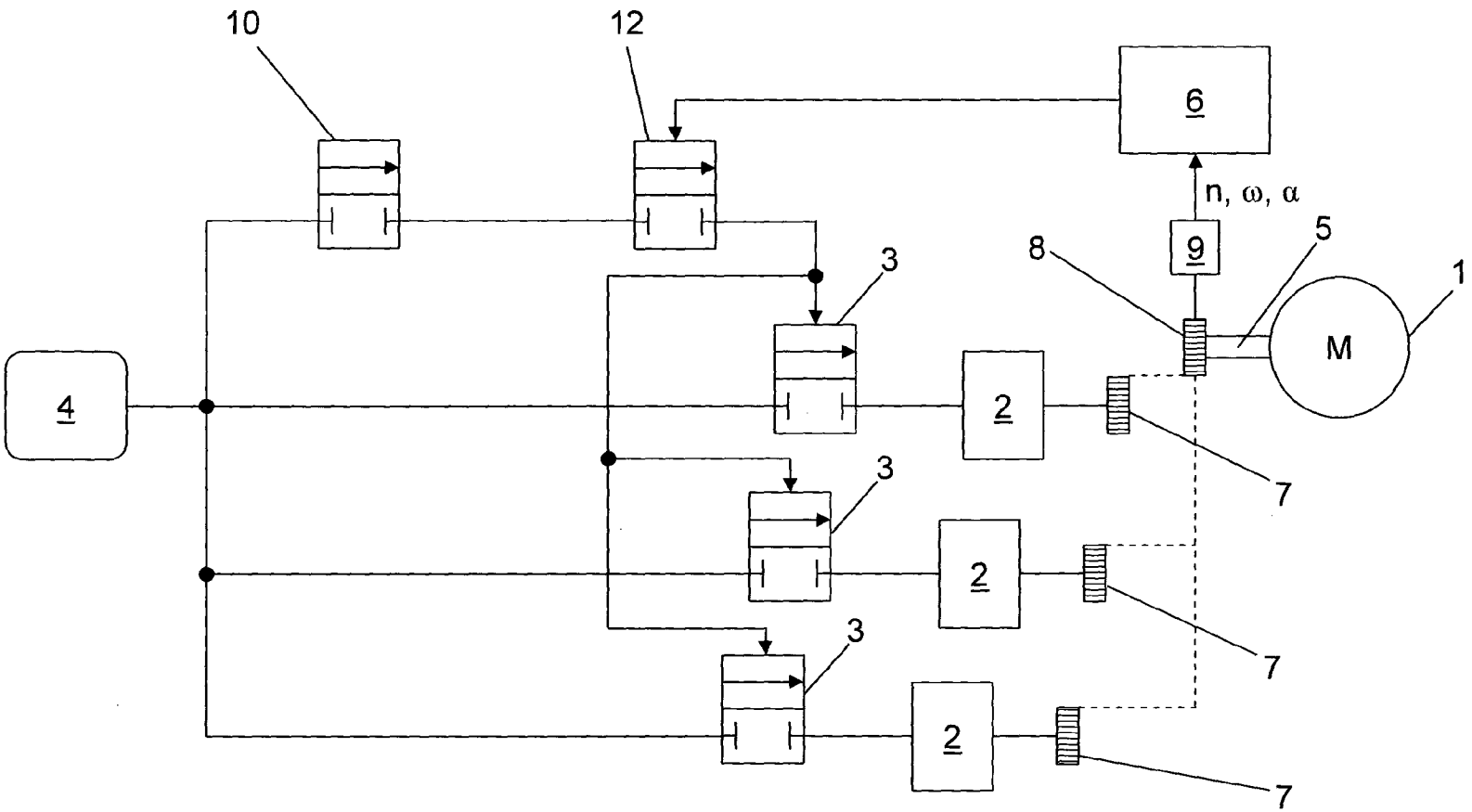
FIG. 4 shows a diagrammatic structure as shown in FIG. 3 with a plurality of starter motors.

FIG. 4 shows an embodiment of a proposed starter system as shown in FIG. 3. In this example, there are provided three starter motors 2 each having a compressed air valve 3 connected upstream thereof. The starting valve 10, the control valve 12 and the compressed air valves 3 are in their closed positions in this view (that is to say, the compressed air feed from the compressed air source 4 to the starter motors 2 is interrupted in each case, and the starter motors 2 do not drive the drive shaft 5 of the internal combustion engine 1).

A variant of the proposed method will now be described with reference to FIG. 4. After activation of the starting process by opening the starting valve 10 connected to the compressed air source 4, meshing mechanisms 11 (not shown here) provide in known manner that the starter pinions 7 of the starter motors 2 are brought into engagement with the ring gear 8 on the drive shaft 5 of the internal combustion engine 1 or are meshed therewith (see FIG. 3). In this case, meshing is indicated by the broken lines.

The control device 6 causes opening of the control valve 12, whereby as a further consequence the compressed air valves 3 are also completely opened. As a result, the starter motors 2 are supplied with compressed air from the compressed air source 4 and can drive the drive shaft 5 of the internal combustion engine 1 by the respective connections comprising starter pinion 7 and ring gear 8. As soon as the actual rotary speed n measured by the measuring device 9 and monitored by the control device 6 reaches a maximum rotary speed $n_{max}$ of for example 20 rpm, the control device 6 causes closure of the control valve 12 and therewith also causes closure of the compressed air valves 3. As a result, the compressed air feed for the starter motors 2 is interrupted whereby the actual rotary speed n of the internal combustion engine 1 decreases. As soon as the actual rotary speed n reaches a threshold value rotary speed $n_s$ of for example 15 rpm, the control device 6 causes opening of the control valve 12. As a result, the compressed air valves 3 are moved into their completely opened positions, and the starter motors 2 are again acted upon with compressed air from the compressed air source 4. By virtue of system-related delays (for example mass inertia of the rotating or moving components), normally there is not an immediate increase in the actual rotary speed n so that after opening of the compressed air valves 3 there can briefly still be a further reduction in the actual rotary speed n. If, however, the resistance is so great, as a consequence of partial flooding of at least one cylinder of the internal combustion engine 1, that the actual rotary speed n falls below a minimum rotary speed $n_{min}$, of for example 8 rpm in spite of the compressed air valves 3 opening, that is detected by the control device 6 and the starting process is broken off. If however the rotary speed does not fall below that predeterminable minimum rotary speed $n_{min}$ the starting process can be continued.

The procedure involving acceleration to the maximum rotary speed $n_{max}$ then reducing the rotary speed to the threshold value rotary speed $n_s$ and then again opening the compressed air valves 3 and thus accelerating the internal combustion engine 1 can be effected preferably a plurality of times, particularly four times. That procedure can also be repeated during a predeterminable time (for example 10 s) or during a plurality of, and preferably two, crankshaft revolutions, whereby the starting process can be broken off as soon as a rotary speed drop involving an actual rotary speed n of less than the minimum rotary speed $n_{min}$ is detected or if the average rotary speed of the internal combustion engine 1 does not reach a predeterminable rotary speed value within a predeterminable time or the predeterminable number of crankshaft revolutions.

Figure 5:
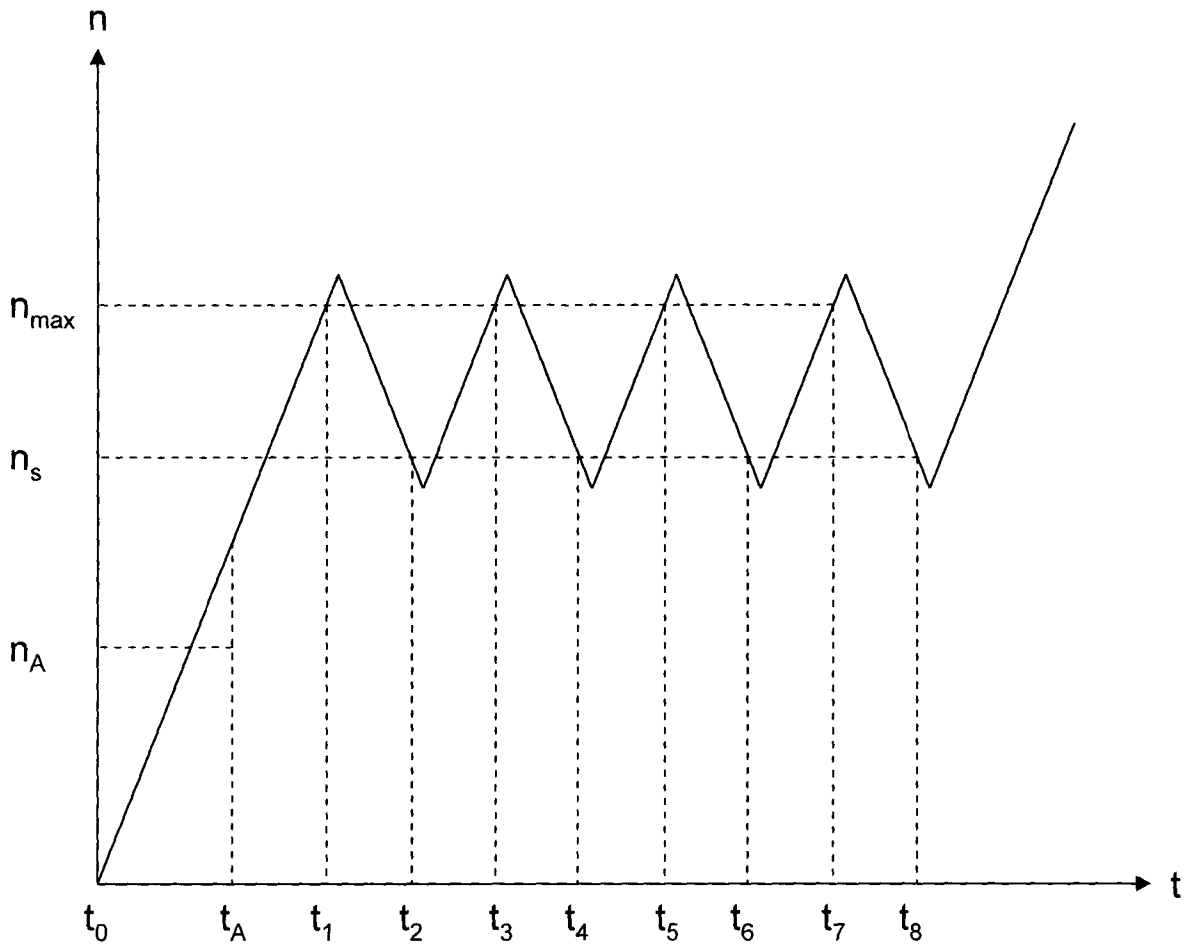
FIG. 5 shows a diagrammatic variation in respect of time of the actual rotary speed of an internal combustion engine during a variant of the proposed method.

FIG. 5 diagrammatically shows the variation in respect of time of the actual rotary speed n of an internal combustion engine 1 during performance of a variant of the proposed method having the devices shown in FIG. 2. At the time $t_0$, the compressed air valve 3 is completely opened and thus the compressed air feed to the pneumatic starter motor 2 is activated. The internal combustion engine 1 accelerates and the actual rotary speed n of the drive shaft 5 of the internal combustion engine 1 is detected by the measuring device 9 and signaled for evaluation to the control device 6.

If the actual rotary speed n of the internal combustion engine 1 does not reach a predeterminable first rotary speed limit value $n_A$ of for example 8 rpm within a predeterminable first time $t_A$ of for example 3 s, the starting process can be broken off to avoid possible damage to the internal combustion engine 1. In the illustrated example, the actual rotary speed n after expiry of the first time $t_A$ however is of a value greater than the first rotary speed limit value $n_A$ so that the starting process does not have to be broken off on the basis of that criterion.

At the time $t_1$ the actual rotary speed n reaches a predeterminable maximum rotary speed $n_{max}$ (for example 20 rpm), whereupon the compressed air valve 3 is completely closed by the control device 6 to interrupt the compressed air feed to the pneumatic starter motor 2. Because of the mass inertia of the rotating or moving components of that arrangement, there is then a reduction in the actual rotary speed n only with a system-related delay. That is represented by the short-term further increase in the actual rotary speed n after the time $t_1$. As soon as the actual rotary speed n reaches a predeterminable threshold value rotary speed $n_s$ (for example 15 rpm) (in this example at the time $t_2$), the control device 6 causes complete opening of the compressed air valve 3. By virtue of the mass inertia, an increase in the actual rotary speed n is again effected only with something of a delay. Closing of the compressed air valve 3 when the actual rotary speed n reaches the maximum rotary speed $n_{max}$ (times $t_1$, $t_3$, $t_5$ and $t_7$) and opening of the compressed air valve 3 when the actual rotary speed n reaches the threshold value rotary speed $n_s$ (times $t_2$, $t_4$, $t_6$ and $t_8$) is performed in all four times in the illustrated example. As no rotary speed drop was detected during that procedure, the internal combustion engine 1 is thereupon accelerated by the starter motor 2 until the engine 1 can automatically continue to run. Disconnection of the starter motor 2 by unmeshing of the starter pinion 7 can be effected for example at an actual rotary speed n of 200 rpm or after a certain time (for example 10 s).

Figure 6:
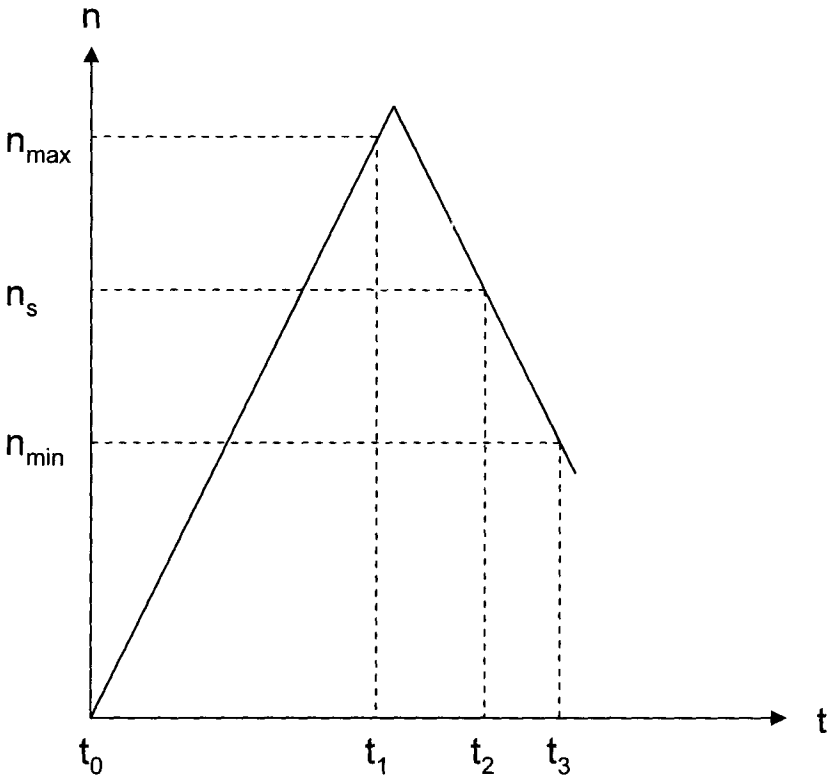
FIG. 6 shows a diagrammatic variation in respect of time of the actual rotary speed of an internal combustion engine, in which at least one cylinder is at least partially flooded with water.

FIG. 6 diagrammatically shows the variation in respect of time of the actual rotary speed n during the procedure shown in FIG. 5. In this case, at least one cylinder of the internal combustion engine 1 is at least partially flooded with water. After complete opening of the compressed air valve 3 at the time $t_2$ as soon as the actual rotary speed n reaches the predeterminable threshold value rotary speed $n_s$ of for example 15 rpm, a rotary speed drop occurs by virtue of the increased resistance of the incompressible water in spite of complete opening of the compressed air valve 3. At the time $t_3$, the rotary speed thereby falls below a predeterminable minimum rotary speed $n_{min}$ of for example 8 rpm and the starting process is broken off, for example by closing the compressed air valve 3.

In general, implementation of the proposed method can also be effected in a higher-order time context. For example, the proposed method can be used only when the internal combustion engine has been in a stopped condition for more than 12 hours. After the starting process is broken off, a fault signal can be produced, which has to be acknowledged. In addition, after a plurality of unsuccessful starting attempts (for example three), a further fault signal can be produced which has to be acknowledged. After a plurality of unsuccessful starting attempts, a compressed air storage loading time of for example 30 minutes can be provided for the compressed air source.

The described method which is suitable in particular for stationary gas engines with engine power outputs of greater than 5 MW is not restricted to avoiding damage during acceleration of an internal combustion engine by virtue of partial flooding of cylinders of the engine with water. Thus the method can also be used for example to avoid damage due to damaged or worn bearings which have the effect of increased frictional values and thus increased levels of resistance to acceleration. In quite general terms, the method according to the invention can be used to detect abnormal or inadmissible resistances to acceleration of an internal combustion engine and can cause the internal combustion engine starting process to be broken off to avoid damage to the engine.

The invention claimed is:

1. A method of starting an internal combustion engine, comprising:

driving the internal combustion engine by starting and operating a pneumatic starter motor supplied by a compressed air feed controlled by a compressed air valve, the compressed air valve being switchable between a completely open position and a completely closed position; and after said starting of the pneumatic starter motor, breaking off a starting process upon detection of water hammer due to an occurrence of at least one of:

an angular acceleration a drive shaft of the internal combustion engine remains below a predetermined acceleration value;

within a predetermined first time period, an actual rotary speed of the drive shaft remains below a predetermined first rotary speed threshold value; and within a predetermined second time period, an average rotary speed of the drive shaft remains below a predetermined second rotary speed threshold value;

wherein said starting of the pneumatic starter motor is effected by completely opening the compressed air valve; and wherein said breaking off the starting process is effected by completely closing the compressed air valve.

2. The method as set forth in claim 1, wherein the predetermined first rotary speed threshold value is less than a predetermined maximum rotary speed of no more than 30 rpm.

3. The method as set forth in claim 1, wherein said breaking off the starting process after said starting of the pneumatic starter motor occurs when the actual rotary speed of the drive shaft remains below 8 rpm within the first predetermined time period of 3 s.

4. The method as set forth in claim 1, wherein said driving the internal combustion engine by starting and operating a pneumatic starter motor includes:

completely opening the compressed air valve to accelerate the actual rotary speed of the drive shaft of the internal combustion engine;

completely closing the compressed air valve immediately after the actual rotary speed reaches a predetermined maximum rotary speed to reduce the actual rotary speed of the drive shaft; and completely opening the compressed air valve immediately after the actual rotary speed falls to a predetermined starting process rotary speed threshold value; and wherein said breaking off of the starting process occurs if, despite the compressed air valve being completely open, at least one of:

the actual rotary speed falls below a predetermined minimum rotary speed; and the angular acceleration of the internal combustion engine remains below the predetermined acceleration value.

5. The method as set forth in claim 4, wherein the predetermined maximum rotary speed is no more than 30 rpm.

6. The method as set forth in claim 5, wherein the predetermined maximum rotary speed is 20 rpm.

7. The method as set forth in claim 4, wherein the predetermined starting process rotary speed threshold value is in a range of between 12 rpm and 18 rpm.

8. The method as set forth in claim 7, wherein the predetermined starting process rotary speed threshold value is 15 rpm.

9. The method as set forth in claim 4, wherein the predetermined minimum rotary speed is less than 10 rpm.

10. The method as set forth in claim 9, wherein the predetermined minimum rotary speed is 8 rpm.

11. The method as set forth in claim 4, wherein each of said driving the internal combustion engine by starting and operating the pneumatic starter motor and said breaking off of the starting process are performed more than once.

12. The method as set forth in claim 11, wherein each of said driving the internal combustion engine by starting and operating the pneumatic starter motor and said breaking off of the starting process are performed four times.

13. A starter system for starting an internal combustion engine, comprising:

a pneumatic starter motor to be connected to a drive shaft of the internal combustion engine for driving the drive shaft, said pneumatic starter motor configured to be driven by compressed air supplied by a compressed air source;

a compressed air valve between the compressed air source and said starter motor, said compressed air valve being switchable between a completely open position and completely closed position;

a control device configured to monitor at least one of an actual rotary speed of the drive shaft, an angular speed of the drive shaft, and an angular acceleration of the drive shaft, and said control device being configured to stop an operation of said pneumatic starter motor upon detection of water hammer based on at least one of an actual rotary speed of the drive shaft, an angular speed of the drive shaft, and an angular acceleration of the drive shaft;

wherein said control device is configured to stop the operation of said pneumatic starter motor by stopping the compressed air supply to said pneumatic starter motor by completely closing said compressed air valve, and said control device is further configured to start the operation of said pneumatic starter motor by allowing the compressed air supply to said pneumatic starter motor by completely opening said compressed air valve.

* * * * *